US011965342B2

(12) United States Patent
Simonsen

(10) Patent No.: US 11,965,342 B2
(45) Date of Patent: Apr. 23, 2024

(54) WIRE MOUNTING SOLUTIONS

(71) Applicant: David John Simonsen, Redding, CA (US)

(72) Inventor: David John Simonsen, Redding, CA (US)

( * ) Notice: Subject to any disclaimer, the term of this patent is extended or adjusted under 35 U.S.C. 154(b) by 0 days.

(21) Appl. No.: 17/492,707

(22) Filed: Oct. 4, 2021

(65) Prior Publication Data

US 2022/0251849 A1 Aug. 11, 2022

Related U.S. Application Data

(60) Provisional application No. 63/087,295, filed on Oct. 4, 2020.

(51) Int. Cl.
*E04B 2/00* (2006.01)
*E04B 1/76* (2006.01)
*E04F 13/08* (2006.01)

(52) U.S. Cl.
CPC ..... *E04F 13/0821* (2013.01); *E04B 1/7629* (2013.01); *E04F 13/0805* (2013.01); *E04F 13/0875* (2013.01)

(58) Field of Classification Search
CPC ..... E04F 13/0875; E04F 13/0821
See application file for complete search history.

(56) References Cited

U.S. PATENT DOCUMENTS 2,641,035 A * 6/1953 Nelsson ..... E04F 13/0821 52/358
2,816,436 A * 12/1957 Nelsson ..... E04F 13/0821 24/350
3,412,515 A * 11/1968 Finon et al. ..... E04F 13/0821 52/489.1
4,598,518 A * 7/1986 Hohmann ..... E04B 1/4178 52/410
4,956,949 A * 9/1990 Francis ..... E04F 13/0821 52/391
5,885,029 A * 3/1999 Kotani ..... B63B 59/04 52/460
10,180,004 B1 * 1/2019 Simonsen ..... E04F 13/0801
2009/0272060 A1 * 11/2009 Lucchesi ..... E04F 13/0821 52/489.1
2014/0311087 A1 * 10/2014 Haddock ..... E04D 13/14 52/801.1
2015/0308125 A1 * 10/2015 Helms ..... E04F 13/0832 156/286

* cited by examiner

*Primary Examiner* — Basil S Katcheves

(57) ABSTRACT

Wire Mounting Solutions providing low embodied carbon insulation and façade mounting systems having unmatched thermal and acoustic performance, high structural strengths, and better able to withstand seismic and hurricane activity where other mounting systems may fail due to being too rigid.

28 Claims, 15 Drawing Sheets

WIRE MOUNTING SOLUTIONS

CROSS REFERENCES TO RELATED APPLICATIONS

The present application claims the benefit of U.S. Provisional Patent Application Ser. No. 63/087,295 filed Oct. 4, 2020.

BACKGROUND OF THE INVENTION

The present invention relates to novel and useful products and methods for mounting rigid insulation and facades to buildings utilizing formed steel wires which are much less expensive and difficult to use than traditional materials and methods, and include everything from the weather barrier to the exterior of the façade system on the building envelope.

There have been many ways to mount insulation to the exterior of commercial buildings including friction fitting the insulation batts between thermal clips and then screwing them to the wall with long screws and plastic caps, using adhesive applied stick pins and lock washers, and using thermally broken pins and lock washers. These methods are either very labor intensive, provide unpredictable results when adhesives are used, or which cause the need for penetrations through the weather barrier which poses risks for water intrusion and direct thermal bridging.

There are also many different Clip and Girt systems used such as stainless steel "L's" and "Z's", fiber reinforced plastics, aluminum extruded shapes and others which are used with and without isolators to help reduce thermal transfer, and which also utilize the insulation mounting systems mentioned above. Most current clip and girt systems attempt to reduce thermal transfer to the building while being easy to use and price competitive. With ever-increasing ASHRAE 90.1 and other thermal standards of eliminating thermal transfer, there's a great need to develop an insulation and façade mounting system that surpasses the current products in thermal performance, ease of use and cost effectiveness.

There are also many different types of facades available to mount onto the Clip and Girt systems as well as directly to substrates of buildings. Most are accomplished using aluminum extrusions and other metal supports around the perimeter of the panels, and which generally use base extrusions which are mounted to the wall followed by the fabricated façade panels mounted onto these base extrusions. These fixings can be mounted to the side, back, and on the returns of different types of façade materials depending on how they're fabricated, with façade materials ranging from phenolic resins to aluminum plate or aluminum composites to fiber reinforced cements and stone finishes. All of these systems are expensive to fabricate, assemble and install so creating a real need to develop an insulation and façade mounting system that satisfies or surpasses all structural requirements for use in all applications such as seismic, of which very few facades have passed, and includes hurricane conditions alongside expected static and dynamic loads associated with commercial buildings.

BRIEF SUMMARY OF THE INVENTION

In accordance with the present application, a novel and useful Wire Mounting Solutions is herein provided including specially shaped wires that will be used as structural attachments as clips for mounting girts as well as clips used in forming and assembly of multiple façade materials, and having multiple concept variations of each. The present invention will provide among the best thermal performances in the industry with minimal materials used in an effort to greatly reduce the carbon footprint and reduce costs. The façade mounting systems will provide high-end aesthetics and with increased potential to pass all current testing for seismic, hurricane, static and dynamic loads, and with simultaneous consideration for thermal movements.

The shaped wires will generally be made of fully hardened stainless steel or galvanized carbon steel spring wire and formed on wire bending machines. The wires may also be welded, press formed, twist formed together, 3D printed or made with other manufacturing or fabrication means to create any conceivable shape including but not limited to holes, springs, straight lines, built in lock washers and lock nuts, and anti-reversal mechanisms, etc. The wires may possess holes or slots for mechanical fasteners to either hold them in a fixed location or allow the slot to move at the fastener location. The wires may have plastics, foams, butyl materials, adhesives, self locking washers and/or other materials added onto or adjacent to them to cover the ends for safety, to minimize vibration, or to help connect to or otherwise interact with itself or other materials, and/or to further minimize thermal and acoustic transfer. The ends of the wires may have threads added to them by use of dies so that the male threaded ends can connect into female threaded attachments such as countersunk nuts when used on standard aluminum cassette panels. As an anti-reversal mechanism, the wires may be formed into coils that allow a fastener to be inserted and provide a minimal amount of expansion to allow it in, but reversing the screw will tighten the coils to help prevent it from backing out. There is no wire shape or feature that can't be made using these wire concepts to attach insulation and façade materials to buildings, to provide surfaces for dry-joint reveals to position against, to allow façade panel resilience with thermal expansion and seismic movements, and to minimize thermal and acoustic transfer.

The Wire Clips may be used over an isolator made of a material such as injection molded plastic in which the isolator helps to reduce thermal transfer and spread the pressure of the loads of the Wire Clips over a larger surface. The wire clip's surface area at the mounting hole to the substrate may be increased by adding to the amount of wire in contact with the isolator at the hole location. The wire's mounting hole will generally be formed in a clockwise direction so that the hole's shape doesn't open when the fastener is tightening. The end of the wire may also be formed upwards so that when the screw head is completely seated the upwardly formed wire end will act as a lock washer to prevent the screw from counter-rotation. These wire clips may be generally in a triangular shape to obtain maximum structural performance for supporting loads vertically and horizontally for both static and dynamic loads, and the triangular shapes may be made using one or more wires. The formed wires may allow for adjustability of the girts so that the building's outer surface may be leveled and planed prior to façade material mounting. If wire clip movement in any direction is needed for seismic, hurricane or other reasons, the formed wires may be made to be less rigid by adding wire length, using a smaller diameter, or a combination. The wire clips can be made to accommodate vertical, horizontal and diagonal sub-girts. The clip wires can be used vertically for walls or horizontally for roofs and soffits, and may be made of any shape wire including round, square, triangular or others.

The sub-girts will be fabricated from materials such as galvanized steel on a roll forming machine with various in-line punches and dies to add holes and slots, or they may be made with a turret press and brake press. The sub-girts may be shapes such as angles, hats, Z's or W's and attach to the wire clips in a manner which allows them to be planed and leveled on the wall without the use of shims. The sub-girts will have holes for the insertion and mounting of insulation and hardware mounting struts.

The frame wires for use with various façade materials may snap or friction fit onto a return leg of the panel and into the first v-groove and then fastened to it permanently using a mechanical fastener. With a series of these frame wires installed onto a panel, a special shaped handle may be placed into the reveal slot of the frame wires so that when the shaped handle is rotated upwards it will cause the frame wires to help form the return legs of the panels to the correct angles. When the panel is formed the frame wires are permanently installed. The frame wires may be made to be less rigid by adding coils, bends or otherwise be lengthened in order to allow them to flex for anticipated movements allowing the wires to move without causing the facade material to deform. On a single panel there may be a variety of flexibility in these frame wires to help different parts of the panel move more or less depending on the façade material and anticipated movements. Variations of the frame wire may connect to different façade materials in ways that compliment those materials, some of which are shown in the drawings. The frame wires may also be able to move freely within the confines of a base extrusion, such as an extruded sill, if one is used.

Guy wires are shaped to attach near the "top" of a clip wire located below and extend upwards to be attached at a plane closer to the building's substrate of the clip wire above the first clip wire. This allows for the tensile strength of the guy wire to support heavier loads when needed, complimenting the load bearing of the wire clips themselves.

It may be apparent that novel and useful Wire Mounting Solutions have been hereinabove described which work and are used in a manner not consistent with conventional products and methods, adding strength to weight ratios and thermal performances never seen before.

It is therefore an object of the present Wire Mounting Solutions is to provide lightweight, strong, durable, inexpensive, seismic and hurricane rated clip wire systems with the highest thermal performance possible.

Another object of the present Wire Mounting Solutions is to provide a guy wire to add significant structural strength to the clip wires with minimal cost in materials and labor, as well as minimal negative impact on thermal performance and other features.

Another object of the present Wire Mounting Solutions is to provide guy wires that are able to add tension, such as by utilizing opposing threaded ends mating into a nut.

Another object of the present Wire Mounting Solutions is to provide a clip wire with adjustable horizontal and vertical connections for the sub-girts, with the sub-girts utilizing existing formed wires that hold in position and support the load of all types of insulation without penetrating or even connecting to the building's substrate.

Another object of the present Wire Mounting Solutions is to provide frame clips that attach to façade panel materials to help form and assemble them.

Another object of the present Wire Mounting Solutions is to provide a panel using frame clips that can be mounted fixed to the panel and to the sub-girt or substrate with nothing that slides or moves to accommodate thermal movement or dynamic load movements except for the spring tension in the wires themselves, so that their flexing when these loads are applied allows for the panels to remain un-deformed when these occurrences happen.

Another object of the present Wire Mounting Solutions is to provide the least possible expensive panel mounting system from the weather barrier to the outside of the panel system.

Another object of the present Wire Mounting Solutions is to provide formed wires that prevent screws from backing out by use of coils and bent wire ends.

Another object of the present Wire Mounting Solutions is to provide stitch wires to quickly and easily ensure that formed corners can't open back up easily.

Another object of the present Wire Mounting Solutions is to provide continuous insulation mounting systems without any materials penetrating or otherwise positioned between the insulation except for the screws.

Another object of the present Wire Mounting Solutions is to provide frame wires that may be installed before or after the panel is formed.

Another object of the present Wire Mounting Solutions is to allow for façade materials to be mounted with or without base extrusions over sub-girts or substrates.

Another object of the present Wire Mounting Solutions is to allow façade materials with formed return legs having angles that vary to allow the panels to shed water outside of the panels better, such that a panel's bottom return leg has a sharper angle to allow water to flow off the end without much capillary action, and the panel's upper return having a lesser angle to allow the water to shed onto the face of the panel.

Another object of the present Wire Mounting Solutions is to provide frame wires and clip wires which may be formed to provide additional wire surface contact to panel returns, isolators and other locations to spread out loads applied from the wires on those substrates.

Another object of the present Wire Mounting Solutions is to provide frame wire shapes having multiple formed holes for fasteners to pass through, allowing for direct attachment to a building's substrate so that no sub-girt is needed to mount a panel to a building substrate.

Another object of the present Wire Mounting Solutions is to provide frame wire shapes and clip wire shapes which utilize the rigidity of insulation to help support heavier loads applied to the attached sub-girts or panels which are mounted to the frame wires or clip wires.

Another object of the present Wire Mounting Solutions is to provide frame wires which may be shaped and connected together at a panel's corner location by a mechanical means such as stainless steel zip ties, helping one frame wire prevent the additionally attached frame wire from moving when under loads.

Another object of the present Wire Mounting Solutions is to allow for any material to be used to make the parts and components of this invention such as plastic, carbon fiber, fiberglass, fiber reinforced plastics, etc., and which may be made using 3D printers such as Markforged machinery which can make one piece stainless steel parts which may normally take an assembly to accomplish the end product.

Another object of the present Wire Mounting Solutions is to provide clip wire shapes which prevent fasteners attaching to sub-girts to move while increasing load capacity and minimizing clip wire movement.

Another object of the present Wire Mounting Solutions is to provide frame wires which utilize the tensile strength of the substantially vertical wires to support the dead loads of the insulation and facades, while the substantially horizontal wires support the dynamic loads imposed on the insulation and façade materials.

Another object of the present Wire Mounting Solutions is clip wires which have more than one sub-girt mounting hole which acts to prevent rotation of the clip wires when more than one fastener is used to conned the clip wires to the sub-girts.

Another object of the present Wire Mounting Solutions is to provide geometric shapes which allow for increased structural strength, decrease thermal transfer to or from the building, and/or decrease vibration (noise) transfer to or from the building.

Another object of the present Wire Mounting Solutions is to provide 3D printing manufacturing allowing for inclusive lock nuts/anti-reversal mechanisms built into one-piece parts.

Another object of the present Wire Mounting Solutions is to provide some locations of a frame wire or clip wire to be more or less flexible in order to accommodate more or less movement of the attached materials as needed for structural, thermal or acoustic performance.

Another object of the present Wire Mounting Solutions is to provide an isolator which allows for snap-in clip wires by providing surfaces which allow the clip wire to enter into but not easily escape from. The clip wires will be slightly deformed by pressing down on it, allowing the clip wires to extend outwards to drop into the isolator's anti-reversal slots, then springing back to it's original shape to permanently connect the clip wire to the isolator. The isolator's means of allowing entry but no escape may be channels, one on each end of the isolator, which have inwardly and angularly facing walls which trap the clip wires in place once installed.

Another object of the present Wire Mounting Solutions is to provide an isolator with channels which allow the top of the clip wires to rest inside of, flush with the surface of the isolator, and where the bottom of the channels are shaped to have as much contact with the clip wires as possible, such as round-bottom channels when used with round clip wires.

Another object of the present Wire Mounting Solutions is to provide insulation and hardware mounting struts which structurally support components such as electrical conduits, conductors, inverters, water pipes and/or other components at or near the location of the panels on a building; supporting conduits and other components up against the insulation or other substrate by partially or wholly encompassing these foreign components alone or in combination with the insulation or substrate.

The invention possesses other objects and/or advantages especially as concerns particular characteristics and features thereof which will become apparent as the specification continues.

Figure 1:
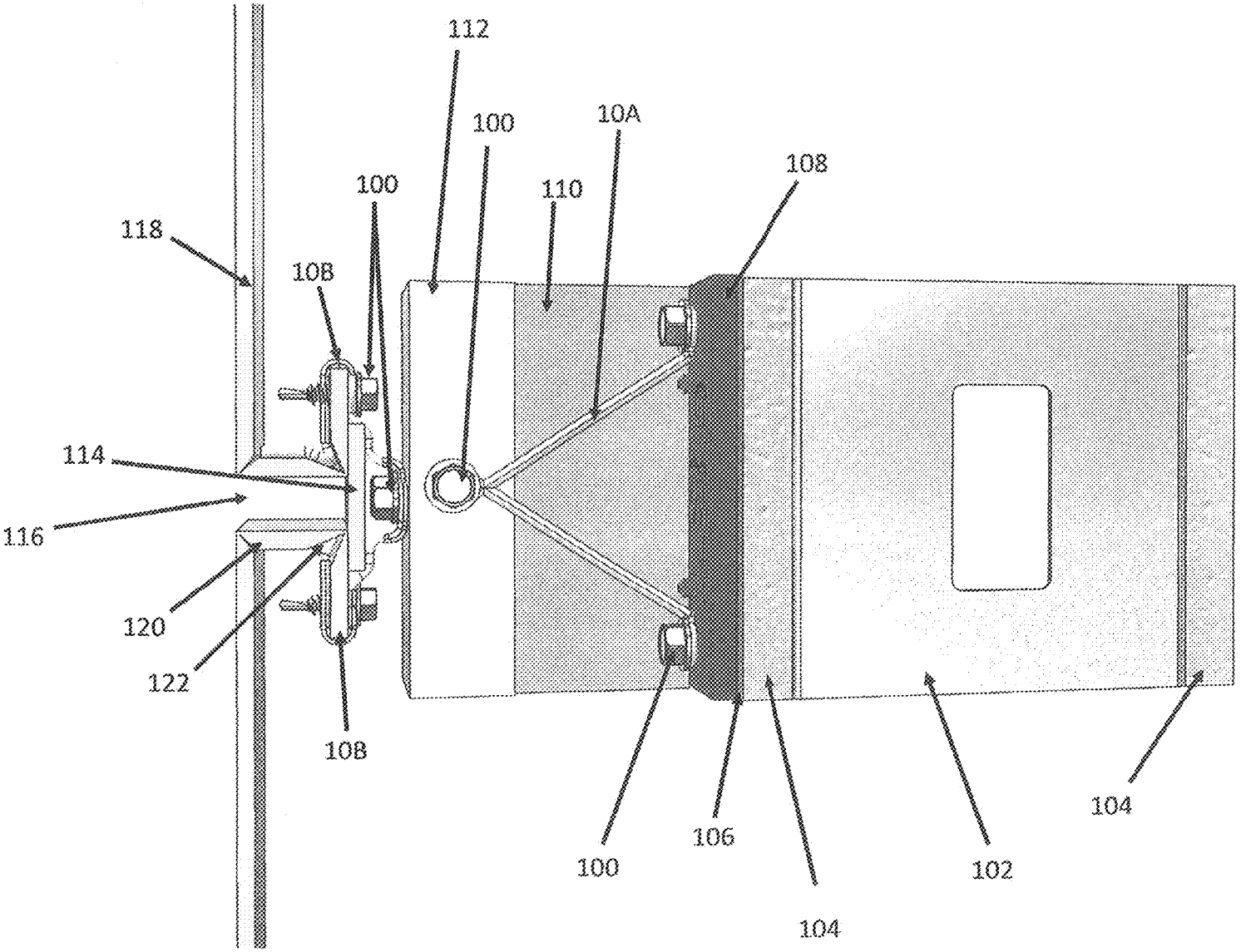
FIG. 1 is a 3D isometric section view of an assembly of the preferred embodiments of the present application.

For a better understanding of the invention of this application, reference is made to the following detailed description of the preferred embodiments thereof which should be referenced to the prior described drawings.

DETAILED DESCRIPTION OF THE INVENTION

Various aspects of the present application will evolve from the following detailed description of the preferred embodiments thereof which should be taken in conjunction with the prior described drawings.

Embodiments of the invention are identified by an upper case letter with an additional upper case letter of the same kind for a variation of the embodiment. Elements of the invention are identified by reference character 10.

With reference to FIG. 1, it can be seen that a preferred embodiment of clip wire 10A and frame wire 10B are shown in a full wall assembly. Sheathing 104 is mounted to steel stud 102 on the interior and exterior of the building, with weather barrier 106 is self-adhered to the exterior sheathing 104. Clip wire 10A is mounted over isolator 108 and fastened to steel stud 102 via fasteners 100. Sub-girt 112 is planed and leveled prior to being secured to clip wire 10A via fastener 100. Insulation 110 is then placed between a series of like mounted clips 10A and sub-girts 112 by friction fitting (not shown). Panels 118 are pre-assembled with frame wires 106 attached which are fastened to sub-girt 112. Panels 118 have double returns (not numbered) made by folding at v-grooves 120 and 122. Reveal 114 is positioned under panels 118 and sandwiched between the outer return legs (not numbered) and the frame wires 108. Reveal opening 116 is a formed opening between opposing panels 118 (shown mirrored to each other, one not numbered).

Figure 2:
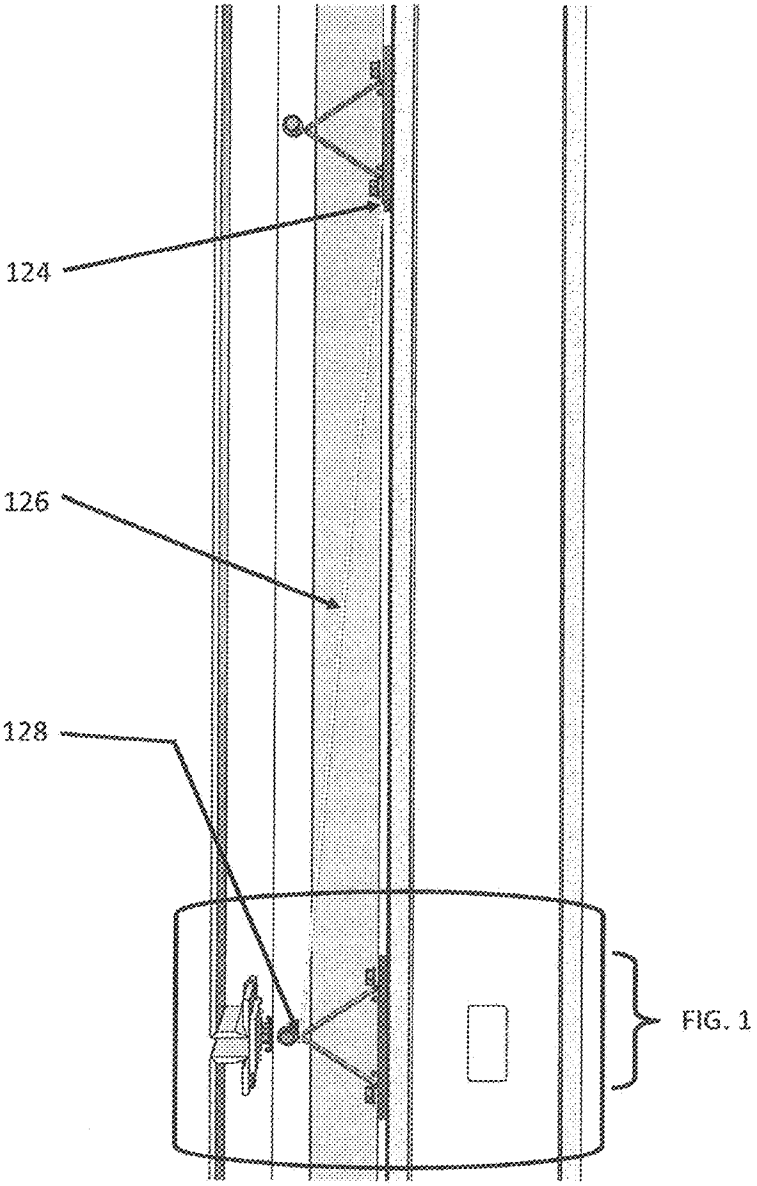
FIG. 2 is a 3D isometric section view of the horizontal joint of FIG. 1 with the addition of a guy wire going from the top of the clip wire of FIG. 1 to the bottom of a dip wire anchor point found at a higher elevation for support of increased loads.

Referring now to FIG. 2, it can be seen that the circled portion is FIG. 1 and guy wire 126 is connecting the top of frame wire 10B from FIG. 1 to the bottom of clip wire 10A which is at a higher elevation. Guy wire 126 has shaped connection ends 124 and 128 for mechanical fastening at connections 124 and 128. Guy wire 126 may be used as a measuring device for placement of subsequent guy wires 126.

Figure 3:
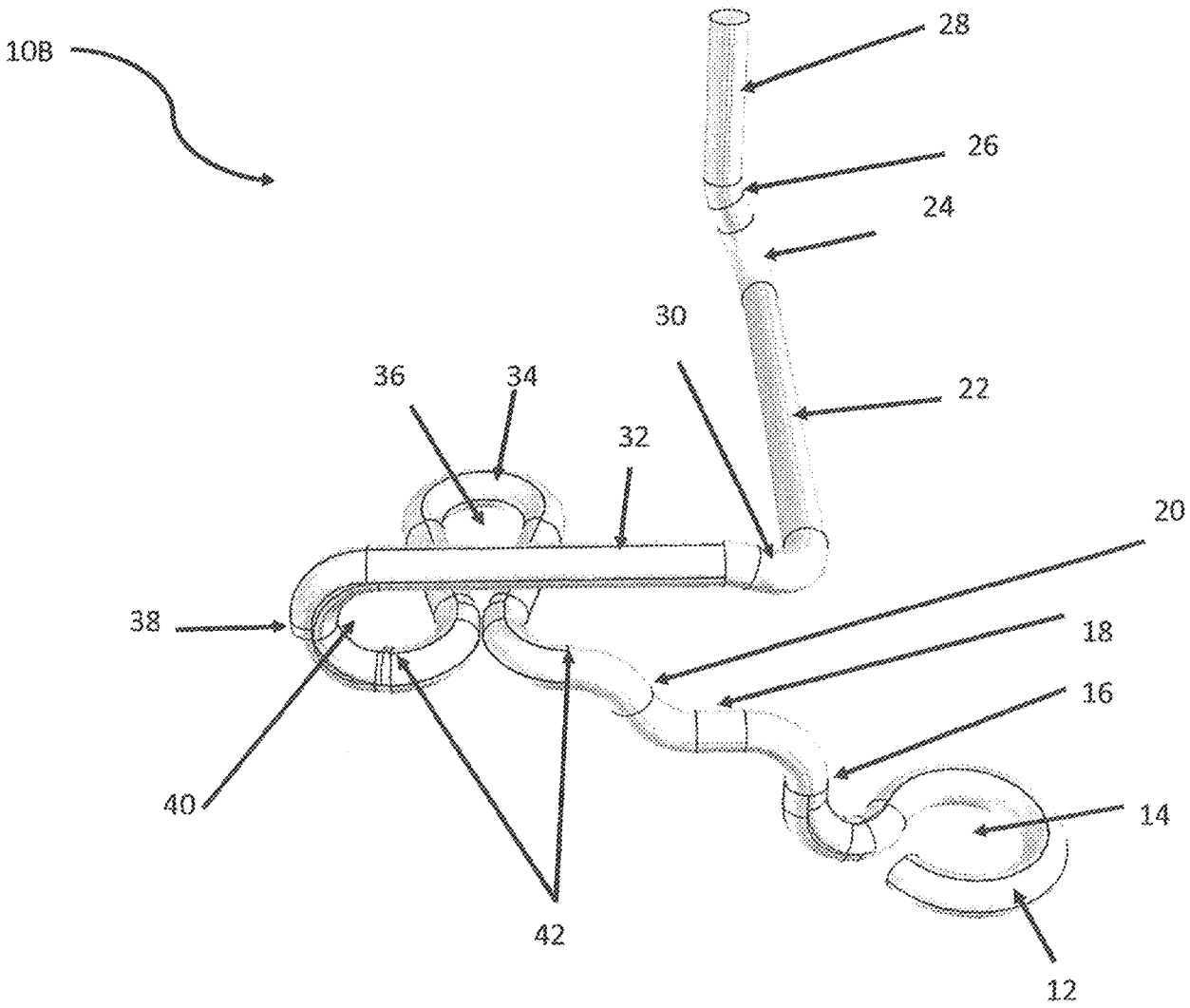
FIG. 3 is a 3D is an isometric plan view of the preferred embodiment of the frame wire.

With reference to FIG. 3, preferred embodiment 10B is shown as having circular end 12 forming mounting hole 14, turning upward on leg 16 to provide room for the mechanical fastener (not shown) to avoid interference with other components. Leg 16 turns to horizontal leg 18 which is the surface that the reveal strip (not shown) rests on between the panels' outer return leg (not shown) of the panels (not shown). Leg 20 proceed upwards again to surfaces 42 which will encompass the panels' outer return leg (not shown) top and bottom. Circular protrusion 34 forms mounting hole 36 for fastener (not shown) to mount to panel's outer return leg (not shown). Upward arch 38 provides opening 40 which may be used to connect two frame clips 10B together at that location using stainless steel zip ties when they are in a panel's corner and perpendicular to each other. Downward bend 30 allows for bend arm 22 to snap into the v-groove (not shown) of panel's outer return leg (not shown). Bend arm 22 will help prevent the panel's outer return leg (not shown) to over bend while causing the panel's inner return leg (not shown) to begin to bend. Bend arm 22 may also be Inserted over panel's outer return leg (not shown) after panel has already been formed. Upward bend 24 allows bend arm 22 to come out of the v-groove (not shown) and bend 26 causes arm 28 to be substantially perpendicular to the panel's inner return leg (not shown).

Figure 4:
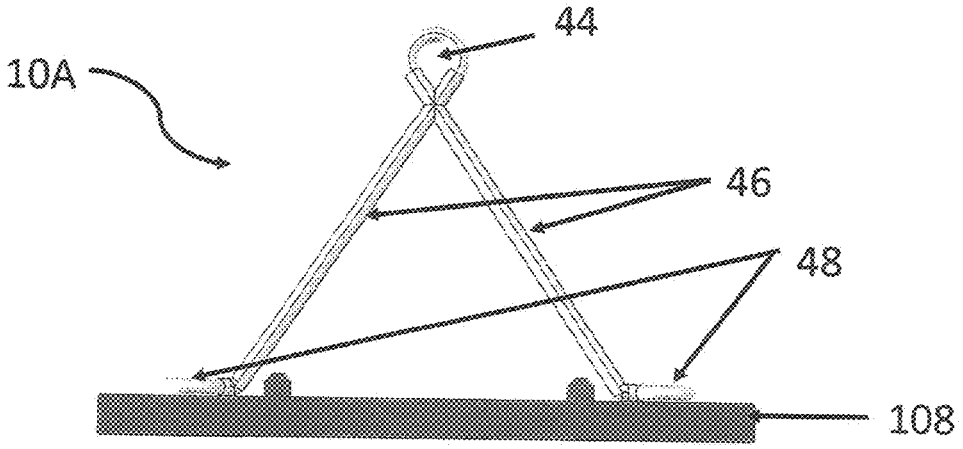
FIG. 4 is a 3D isometric elevation view of the preferred embodiment of the clip wire and isolator assembly positioned horizontally.

FIG. 4 shows clip wire 10B having formed mounting holes 48 on either end of it, and triangulated legs 46 shown which oppose each other to support loads (not shown) when applied to it from any direction except the side. At least one fastener hole 44 is used for fasteners to connect clip wire 10B to sub-girts (shown in FIG. 1). Legs 46 may be at differing angles (not shown) to allow for vertical forces (not shown) to be primarily applied to the tensile strength of a substantially vertical leg 46 while dynamic forces (not shown) from wind loads (not shown) may be primarily applied to the tensile and compressive strengths (not shown) of a substantially horizontal leg 46. The wire (not numbered) around mounting holes 48 may extend to both sides of clip wire 10B to support loads from the side (not shown).

Figure 5:
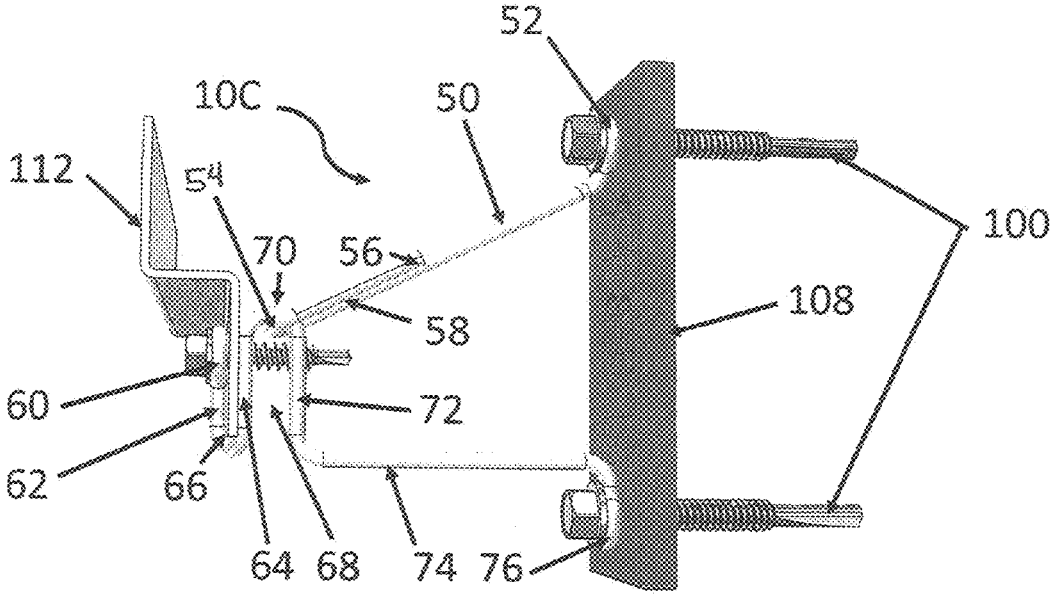
FIG. 5 is a 3D isometric elevation view of an alternative 2 piece assembled embodiment of the clip wire with a horizontally mounted sub-girt and plastic isolator attached at either end.

FIG. 5 shows alternative clip wire embodiment 10C assembly with inclusive guy wire 50 having mounting hole 52, attachment bend 54 and return hook 56. Return hook 56 is used to position through slot 68 and inside of bend 70 to form a single embodiment of clip wire 10C when attached to isolator 108. Attachment bend 54 is in contact with attachment bend 70 of clip wire 10C's main arm 74. Main arm 74 having mounting hole 76 on one end and going the other direction has arm 72 and 64 which connect to form attachment bend 70 and form slot 68. From arm 64 bend 66 allows for enough pitch to create gap (not numbered but is where sub-girt 112 is resting) for sub-girt 112 to fit into between arms 62 and 64. Attachment hole 60 is at the end of arm 62 for fastener 100 to secure sub-girt 112 to clip wire 10C assembly. Isolator 108 is secured by long fasteners 100 through mounting holes 52 and 76, with long fasteners attaching to a substrate (not shown). Leg 58 may extend straight as shown or may be made circular (not shown) to increase resistance to bending when under load. Isolator 108 may have severely radiused edges (not shown) to minimally displace insulation materials (not shown) once installed.

Figure 6:
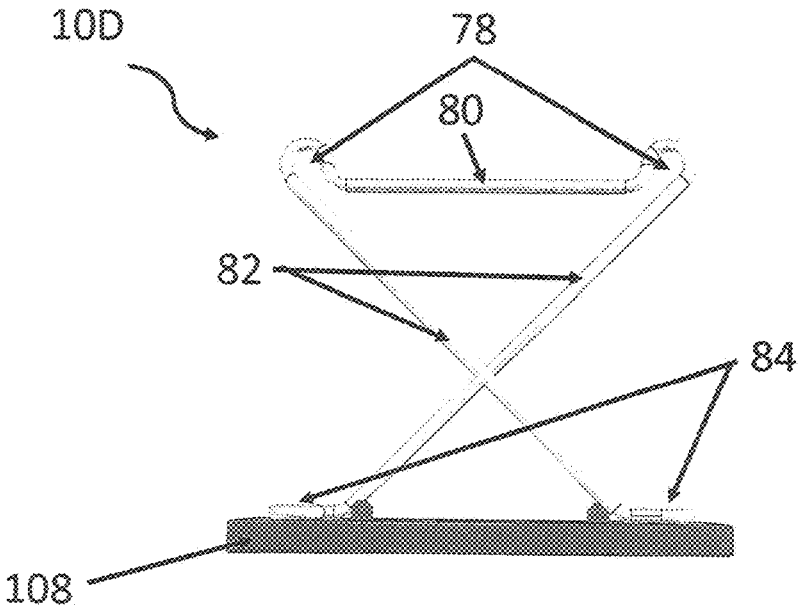
FIG. 6 is a 3D isometric elevation view of an alternative 1 piece embodiment of the clip wire positioned horizontally over a plastic isolator.

FIG. 6 shows alternate clip wire embodiment 10D on top of isolator 108 which is adjacent to mounting holes 84. Triangulated arms 82 oppose each other and extend to two mounting holes 78 in order to provide increased structural strength and rotation of clip wire 10D in comparison to a single hole attachment. Arm 80 separates mounting holes 78 at a pre-determined distance.

Figure 7:
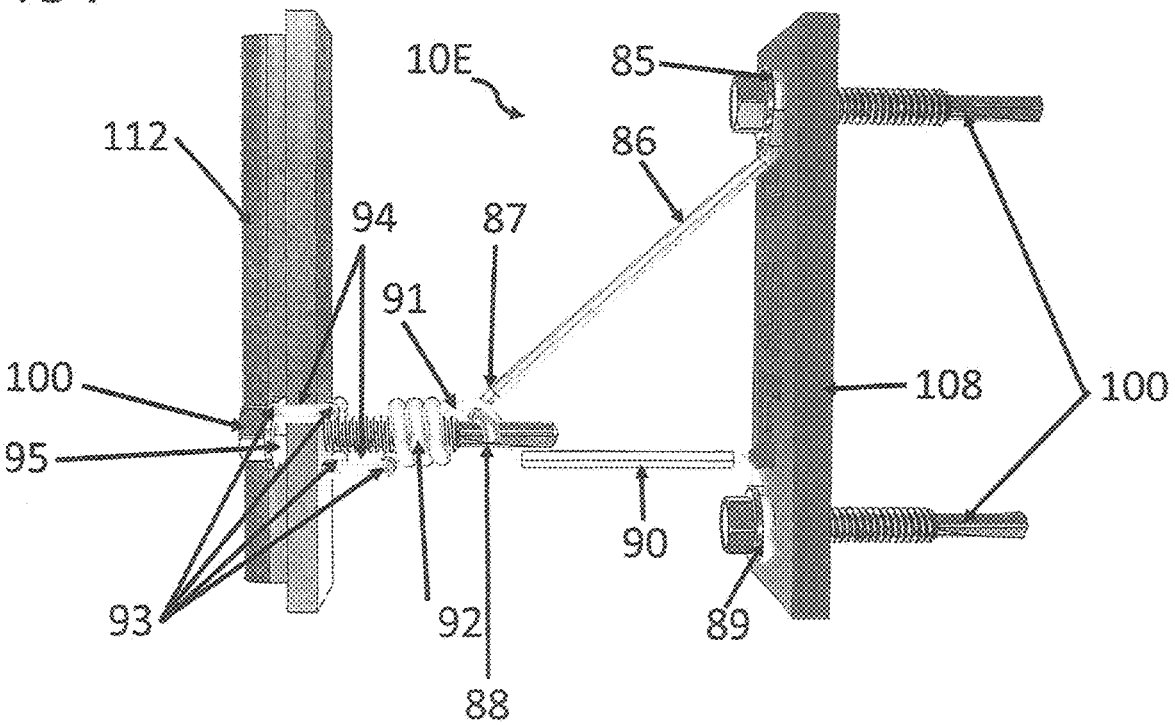
FIG. 7 is a 3D isometric elevation view of another 2 piece assembled embodiment of the clip wire with anti reversal coils for the sub-girt mounting screw as well as multiple locations where the sub-girt can be mounted. If the sub-girt is mounted closer to the building's substrate the upper wire portion can be cut off and removed so it can't interfere with panel mounting. The guy wire shown is shaped to prevent the screw from flexing the upper portion of the main clip wire which will increase load capacity with minimal deflection from the load.

FIG. 7 shows alternate clip wire 10E assembly mounted over isolator 108 by long fasteners 100 and into building's substrate (not shown). Guy wire 86 has mounting hole 85 on one end and bend 87 which wraps across and around long fastener 100 and terminates at end 88. Clip wire 10D's main wire 90 has mounting hole 89 on isolator 108 end, with one-eighty degree bend 91 in contact with bend 87 of guy wire 86 so that they become one assembly. Coil 92 is wound counter-clockwise so that fastener 100 is inserted in it will open up and allow it in. If fastener 100 tries to back out coil 92 will tighten and not allow it to back out. Slots 94 are formed by legs 93 which terminate at mounting hole 95 with fastener 100 positioned through sub-girt 112.

Figure 8:
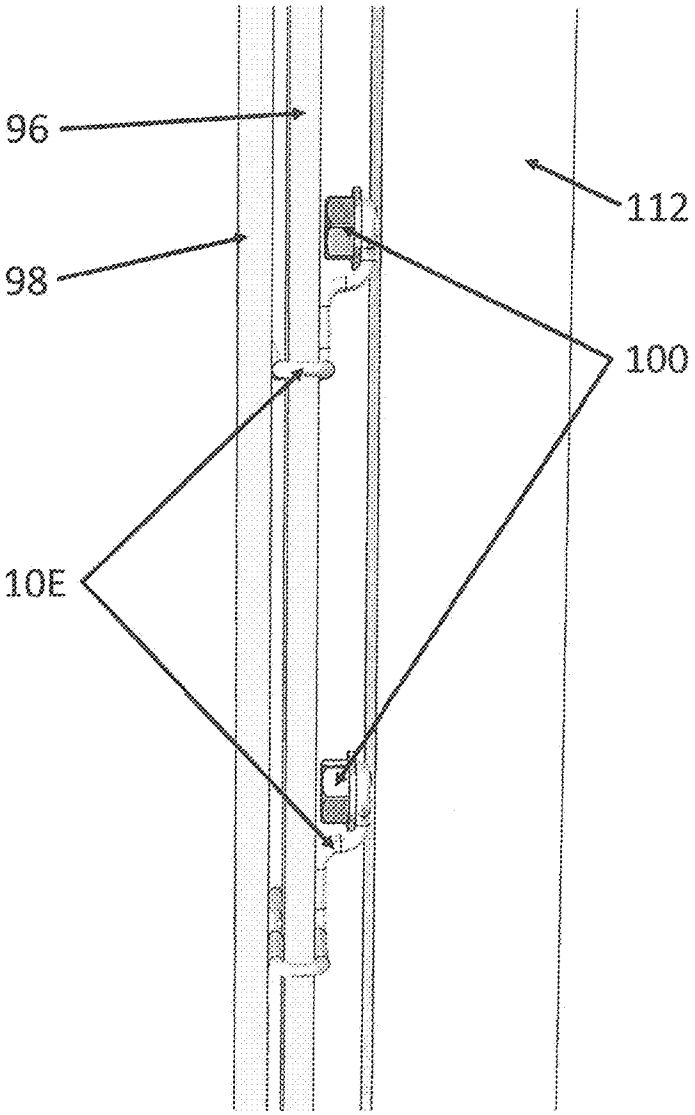
FIG. 8 is a 3D isometric section view of an alternative embodiment of the frame wire connected to flat phenolic panels and an inner reveal shown, mounted vertically.

FIG. 8 shows alternate frame wire embodiment 10E mounted to sub-girt 112 by fasteners 100, and holding reveal 96 and panels 98.

Figure 9:
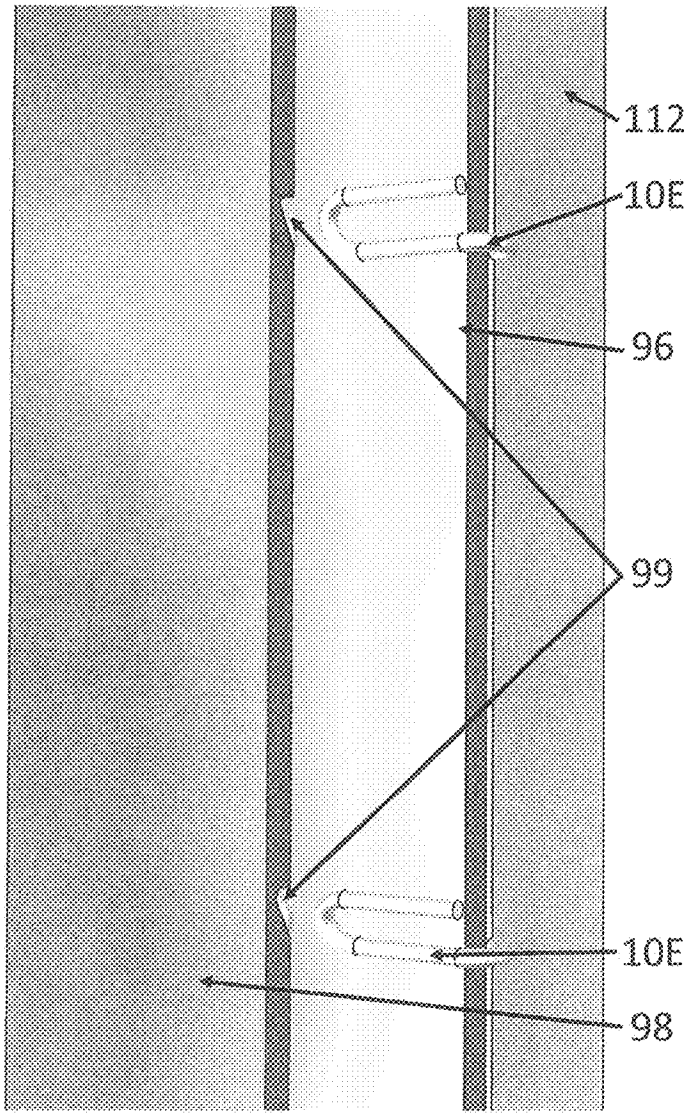
FIG. 9 is a 3D isometric plan view of FIG. 8 showing one panel removed.

FIG. 9 shows FIG. 8 with one panel 98 removed so that one panel 98 remains as well as reveal 96. Holes 99 are shown where frame wire 10E arms (not numbered here) are inserted.

Figure 10:
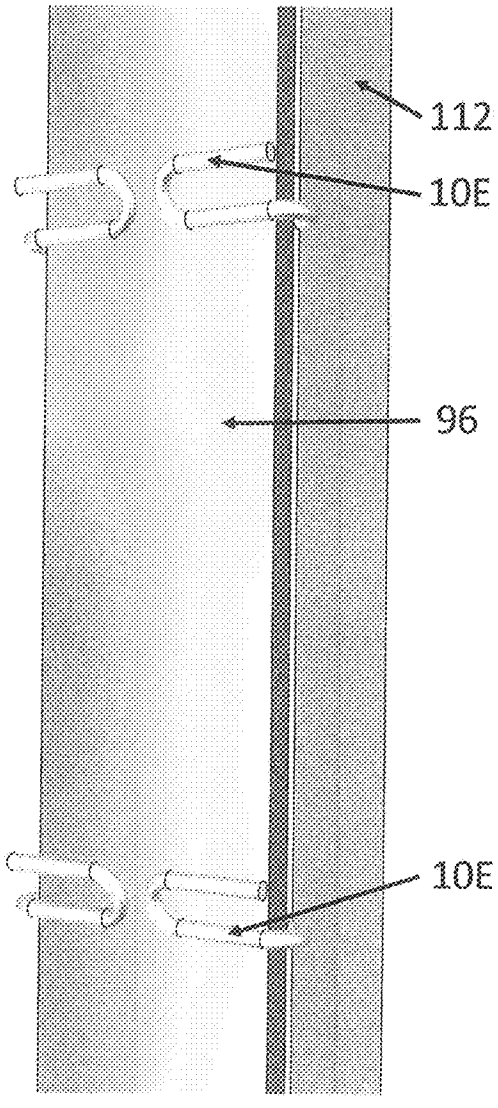
FIG. 10 is a 3D isometric plan view of FIG. 8 showing both panels removed and leaving the reveal and parts of the alternative frame wires exposed.

FIG. 10 shows FIG. 8 with both panels 98 removed.

Figure 11:
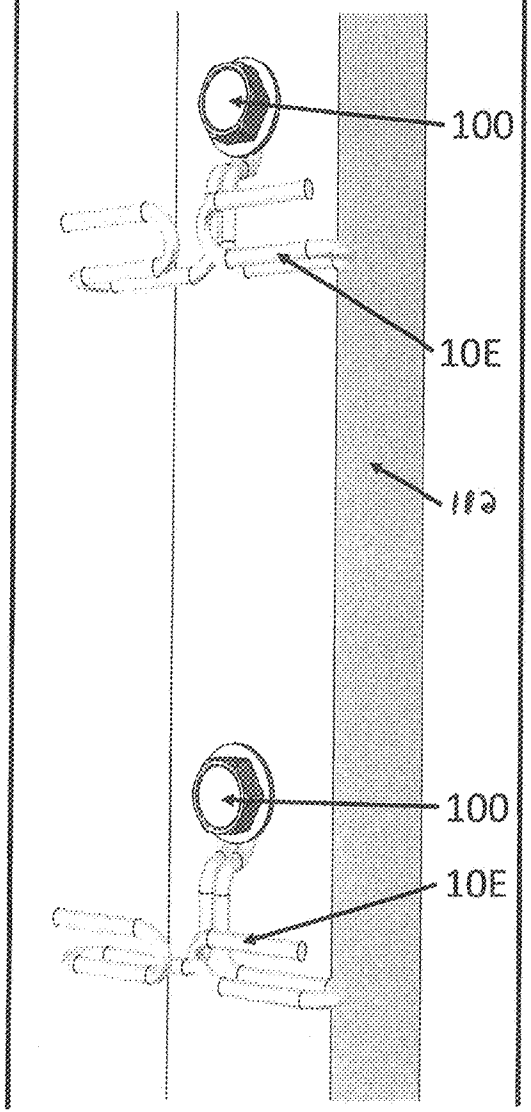
FIG. 11 is a 3D isometric plan view of FIG. 8 with the panels and reveal removed showing only the alternative frame wires attached to the sub-girt.

FIG. 11 shows FIG. 8 with reveal 96 removed as well exposing fasteners 100 which are attached to sub-girt 112.

Figure 12:
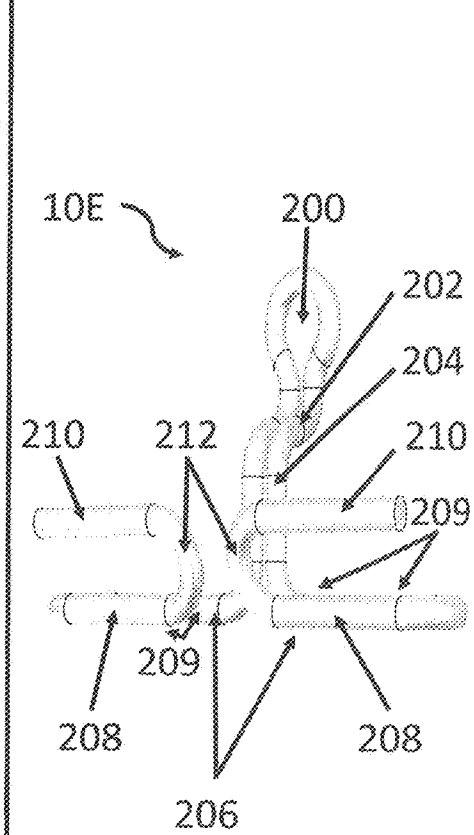
FIG. 12 is a 3D isometric plan view of the alternative frame wire of FIG. 8.

FIG. 12 shows frame wire 10E having mounting hole 200 with two perpendicular legs 202 creating a gap for fastener 100 (not shown) to have clearance. Double Shelf 204 are in plane with wide arms 209 and create slots 206 below arms 208. Slots 206 house reveal 96 (shown in FIG. 8). Bends 212 allow enough pitch for terminating arms 210 to enter the holes (not shown) of panels (not shown).

Figure 13:
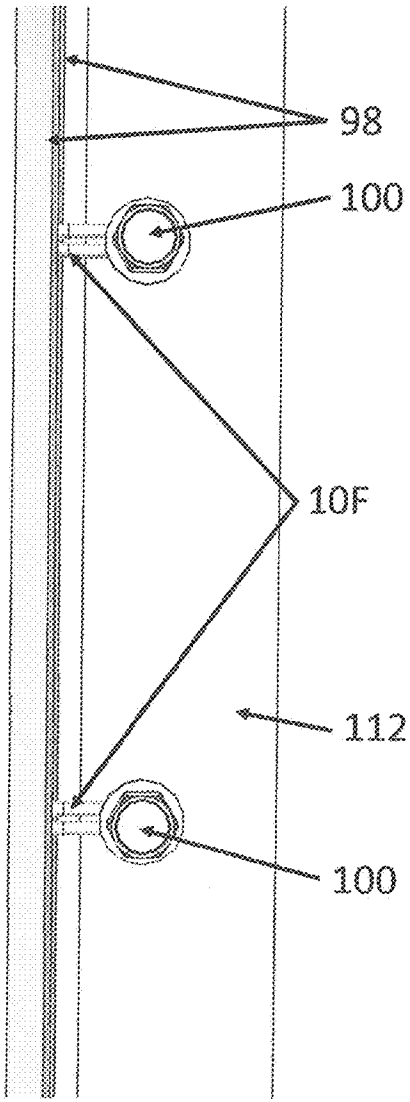
FIG. 13 is a 3D isometric section view of another alternative frame wire embodiment connected to flat phenolic panels without a reveal, mounted vertically.

FIG. 13 shows alternate frame wire embodiment 10F mounted to sub-girt 112 by fasteners 100. Panels 98 are shown suspended by frame wire embodiment 10F.

Figure 14:
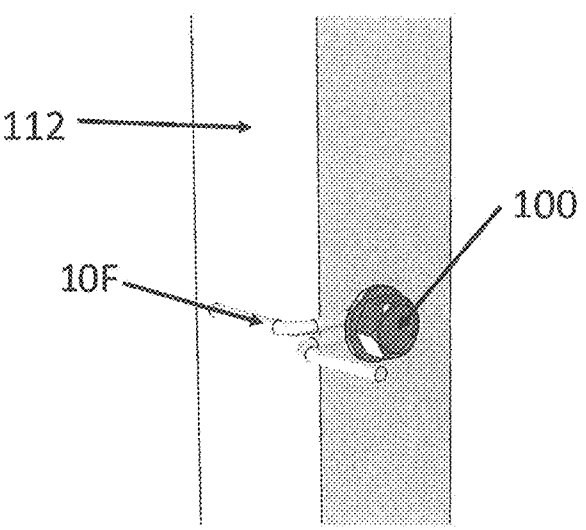
FIG. 14 is a 3D isometric plan view of the alternative frame wire of FIG. 13 attached to a sub-girt.

FIG. 14 shows FIG. 13 with panels 98 removed and exposing frame wire embodiment 10F.

Figure 15:
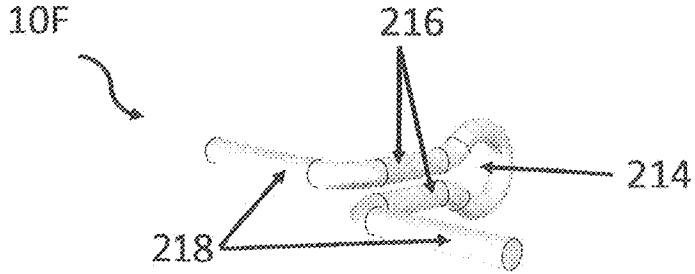
FIG. 15 is a 3D isometric elevation view of the alternative embodiment of the frame wire of FIG. 13.

FIG. 15 shows frame wire embodiment 10F with mounting hole 214, arms 216 and insertion arms 218. Insertion arms 218 may be angled to be in plane with each other (not shown here), and which enter holes (not shown) in panels 98 of FIG. 13.

Figure 16:
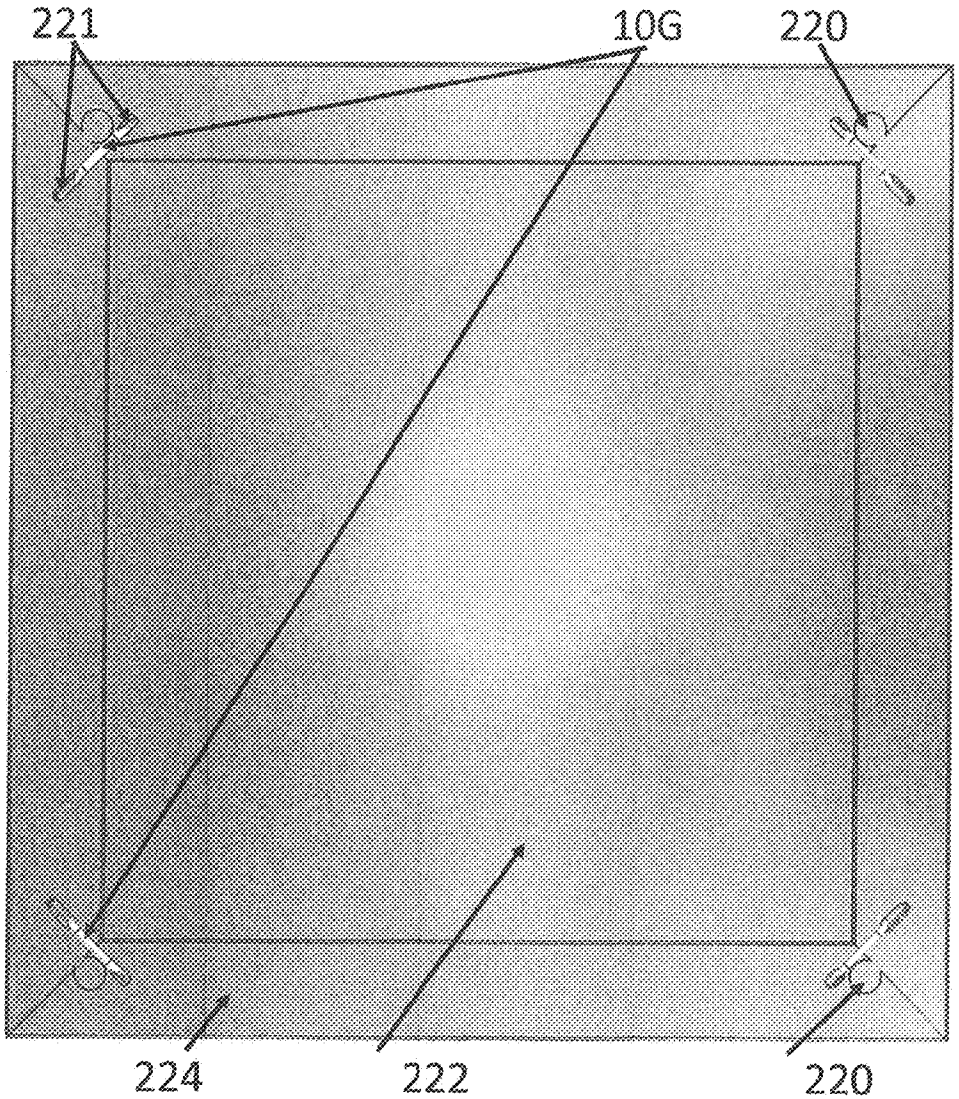
FIG. 16 is a 3D isometric plan view of the back side of an assembled double return panel with puzzle assembled corners and stitch wires.

FIG. 16 shows preferred panel stitch wire embodiment 10G installed into inside return 224 of panel 222. Puzzle connections 220 hold the panel corners together while stitch wires 10G may or may not be mounted over the top of puzzle connections 220. Stith wires 10G mounts through existing holes 221 for permanent fixing when bends 232 and 240 (shown in FIG. 18) cause ends 230 and 242 (shown in FIG. 18) to contact the inside of inside return 224. In some façade materials such as aluminum composites (not shown) stitch wire 10G may penetrate through and create holes 221 during insertion (not shown), and where bends 240 and 232 (shown in FIG. 18) cause ends 230 and 242 (shown in FIG. 18) to contact the back of return leg 224 by use of equipment such as stapling equipment (not shown).

Figure 17:
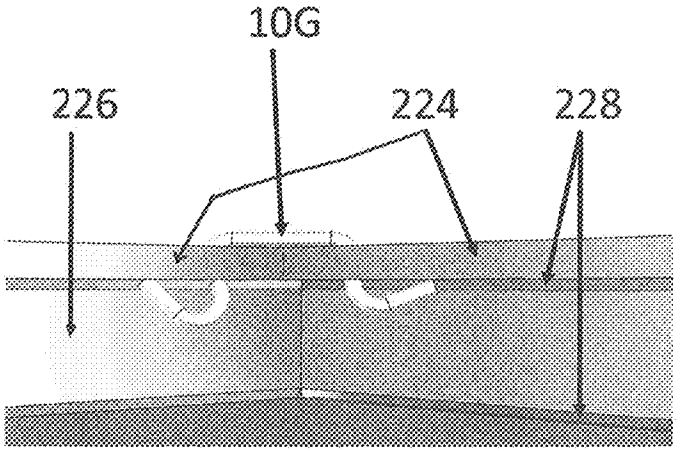
FIG. 17 is a 3D isometric section view of a stitch wire installed in the corner of the panel of FIG. 16 showing that it will prevent both panel return legs from moving.
Figure 18:
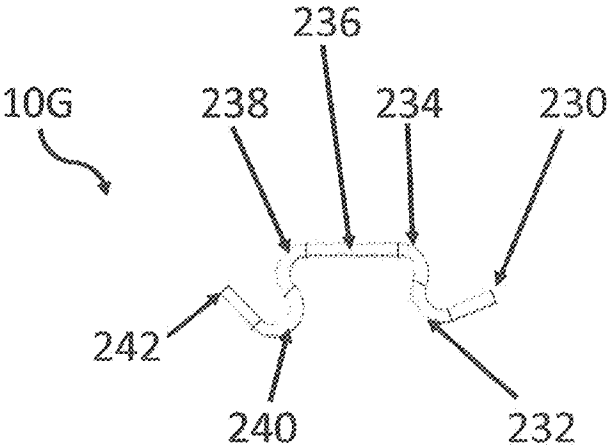
FIG. 18 is a 3D isometric plan view of the stitch wire.

FIG. 17 shows stitch wire 10G fully inserted and locked in place so that it can't come back out. Referring to FIG. 18 numbers, Stitch wire 10G is installed by inserting end 230 into slot 221 (shown in FIG. 16) of one outer return leg 224. Stitch wire 10G is then rotated so that bend enters slot 221 of perpendicular outer return leg 224. Arm 236 is pressed so that end 242 bends slightly until end 242 is fully inserted into slot 221. Stich wire 10G is then not able to be removed and the corners of the panels (shown but not numbered) are permanently secured in place.

FIG. 18 shows stitch wire embodiment 10G having end 230 with bend 232 beyond 90 degrees, extending to bend 234 also beyond 90 degrees, extending to leg 236 which goes to bend 238 having an angle greater than 90 degrees, then to bend 240 which is also greater than 90 degrees, and finally terminating in end 242. Ends 242 and 230 contact the backside of outer panel returns 224 and arm 236 contacts the front side of outer panel returns 224 so that tension is created to prevent outer panel returns 224 from moving.

Figure 19:
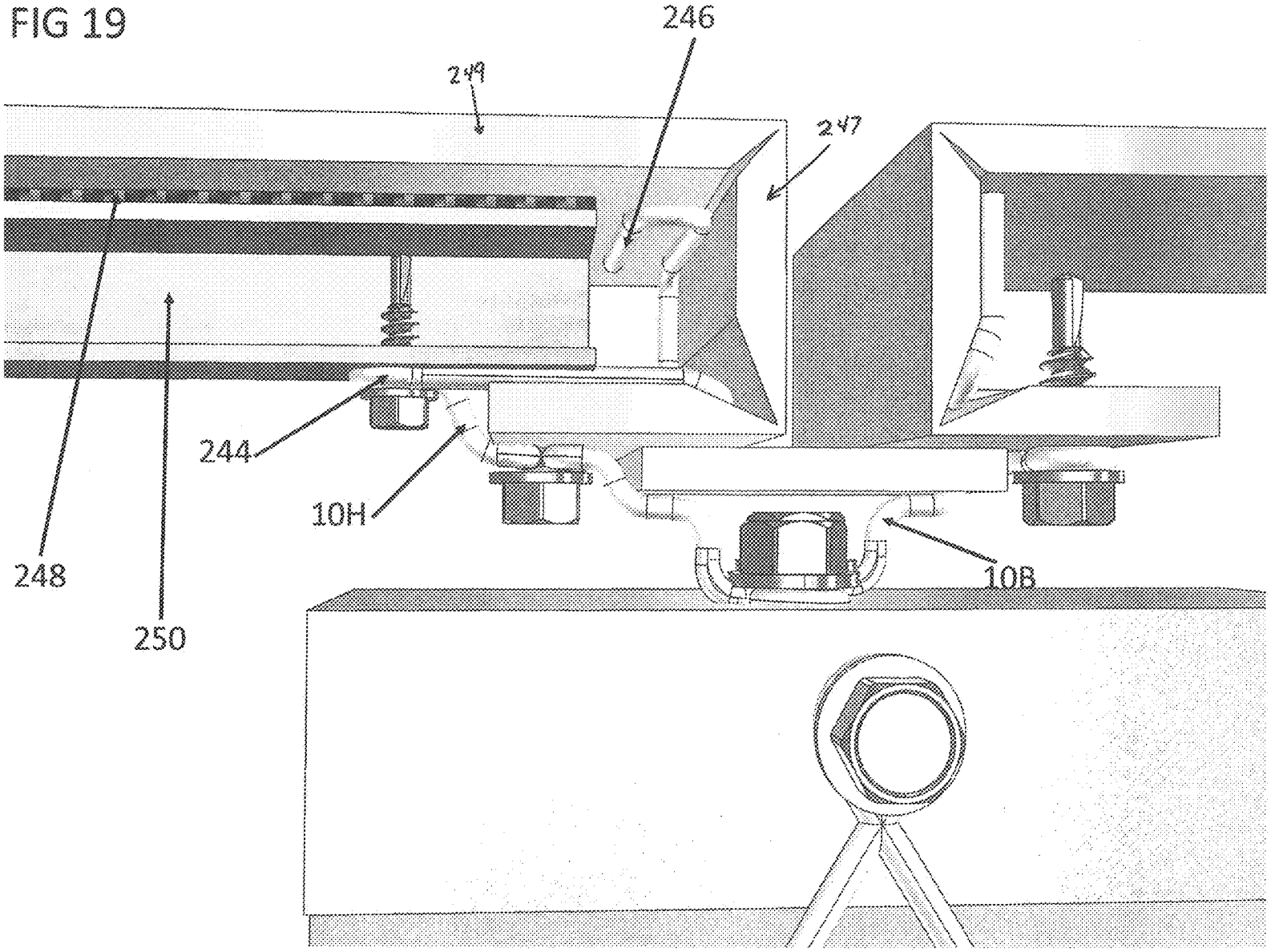
FIG. 19 is a 3D isometric section view of an alternative embodiment of the frame wire of FIG. 8 installed in a complete assembly and having it's wire formed to include an attachment for stiffeners built in as well as additional support for the inner return leg and back of the façade.

FIG. 19 shows alternate frame wire 10H embodiment as an extension of preferred frame wire 10B having attachment hole 224 extending off the back so that fastener 100 can attach to stiffener 250 which is attached to the panel 249 via adhesive 248. Support arms 246 show that they may be added anywhere to offer support, in this case to inner return leg 247 and backside of panel 249. Attachment to stiffener 250 ensures that no movement of frame wire 10H will not move with large panel sizes.

Figure 20:
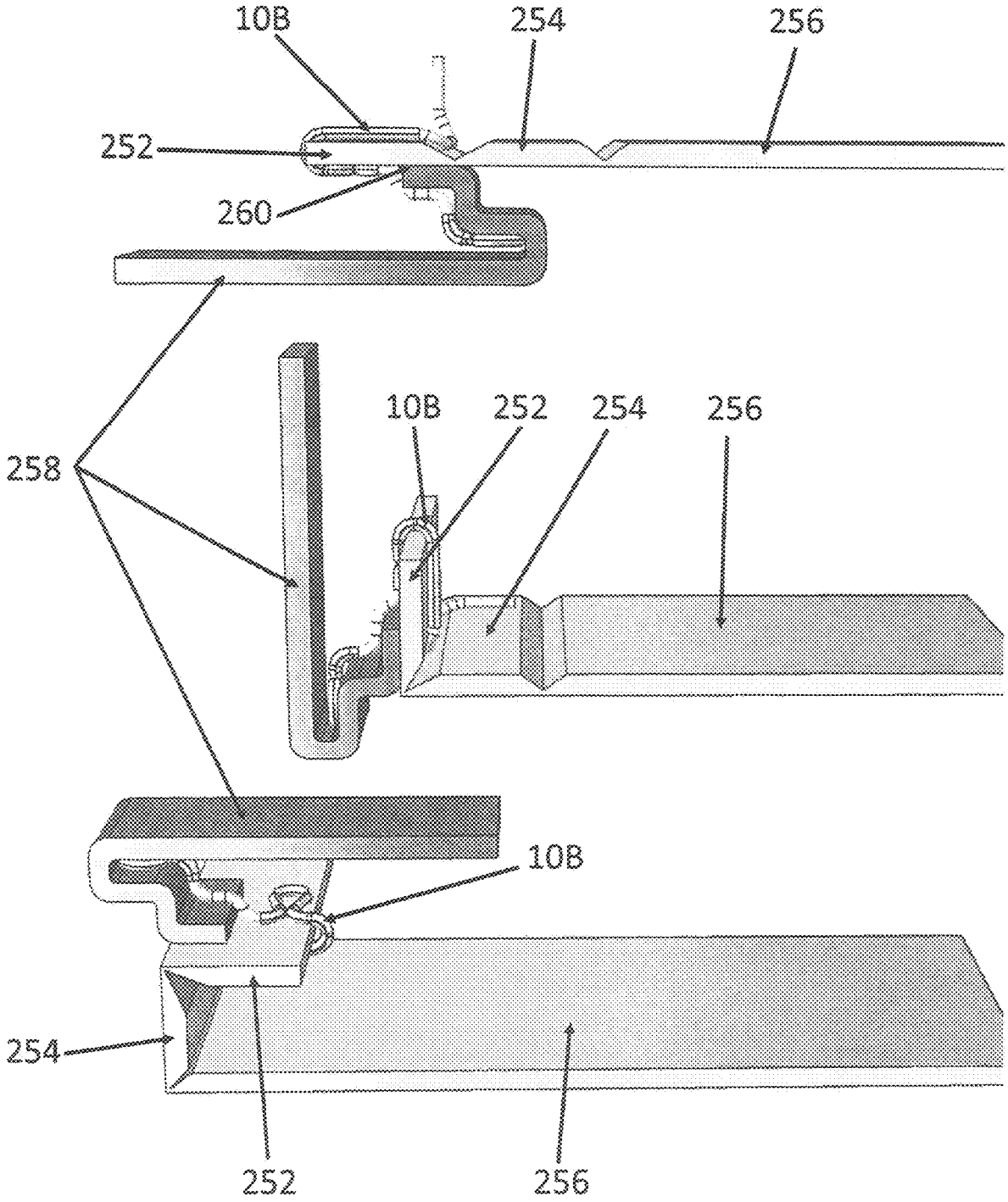
FIG. 20 is a 3D isometric section view of the process of bending the double return panel legs of the preferred embodiment of FIG. 1.

FIG. 20 shows how preferred embodiment of frame wire 10B helps to form panel returns 252 and 254 of panel 256. At the top frame wire 10B is installed onto outer return leg and folding tool 258 is inserted around frame wire 10B and between outer return leg 252. When folding tool 258 is lifted, contact is made to push outer return leg 252 up at location 260 while frame wire 10B Is being pulled downward. In the middle it shows outer return leg 252 fully formed. At the bottom it shows the completely formed panel returns 252 and 254. Note that a fastener (not shown) can be installed through frame wire 10B before or after forming panel return legs 252 and 254. Folding tool 258 may also be used to form panel return legs 252 and 254 without frame wires 106 installed by slipping panel return leg 252 into the lower slot (where frame wire 108's mounting hole is located) and following the same motions.

Figure 21:
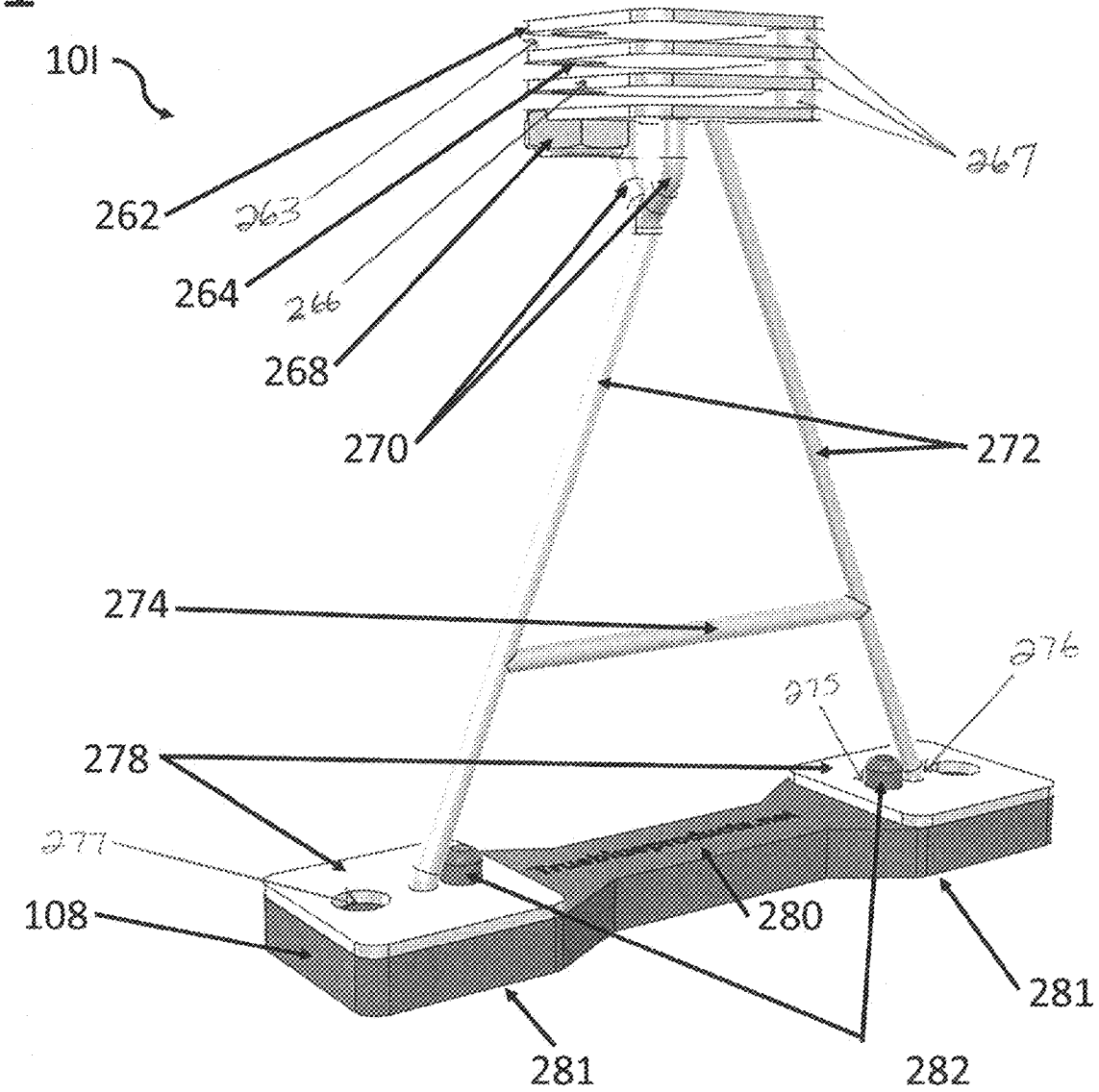
FIG. 21 is a 3D isometric elevation view of a 3D printed version of the wire clip of the present invention.

FIG. 21 shows 3D printed clip wire 10I having mounting platform 262 which is comprised of multiple openings 263 divided by levels 266 which are separated by level support 267 that connects all levels 266 together in one corner of mounting platform 262 so that there is no other support within mounting platform 262. Holes 264 are in alignment and penetrate through all levels 266 and guides screws (not shown here) into anti-reversal device 268 which is built into the lowest level 266. Supports 270 allow for better support of mounting platform 262 that it has 1 or more contact points connecting to mounting platform 262 (3 shown when including support arm 272). Support arms 272 are triangulated in shape to help with structural strength of this 3D printed wire clip. Lateral support 274 help with structural strength as well. Connections 276 to base plates 278 constitute a continuous part with 3D printing and may include fillet material (not shown) at this location for added structural strength of clip wire 10I. Isolator 108 is made of material such as injection molded HDPE and has insignia 280 shown. Holes 281 (not shown but arrows showing the general location) on the bottom of isolator 108 in order for studs 282 to fit inside of each other when in shipping and prior to assembly. Studs 282 friction fit into holes 275 when assembled. Base plates 278 has holes 277 that match up with holes in isolator 108 for mounting screws (not shown) to pass through and connect to a substrate until the head of the screw is tight against mounting plates 278.

Figure 22:
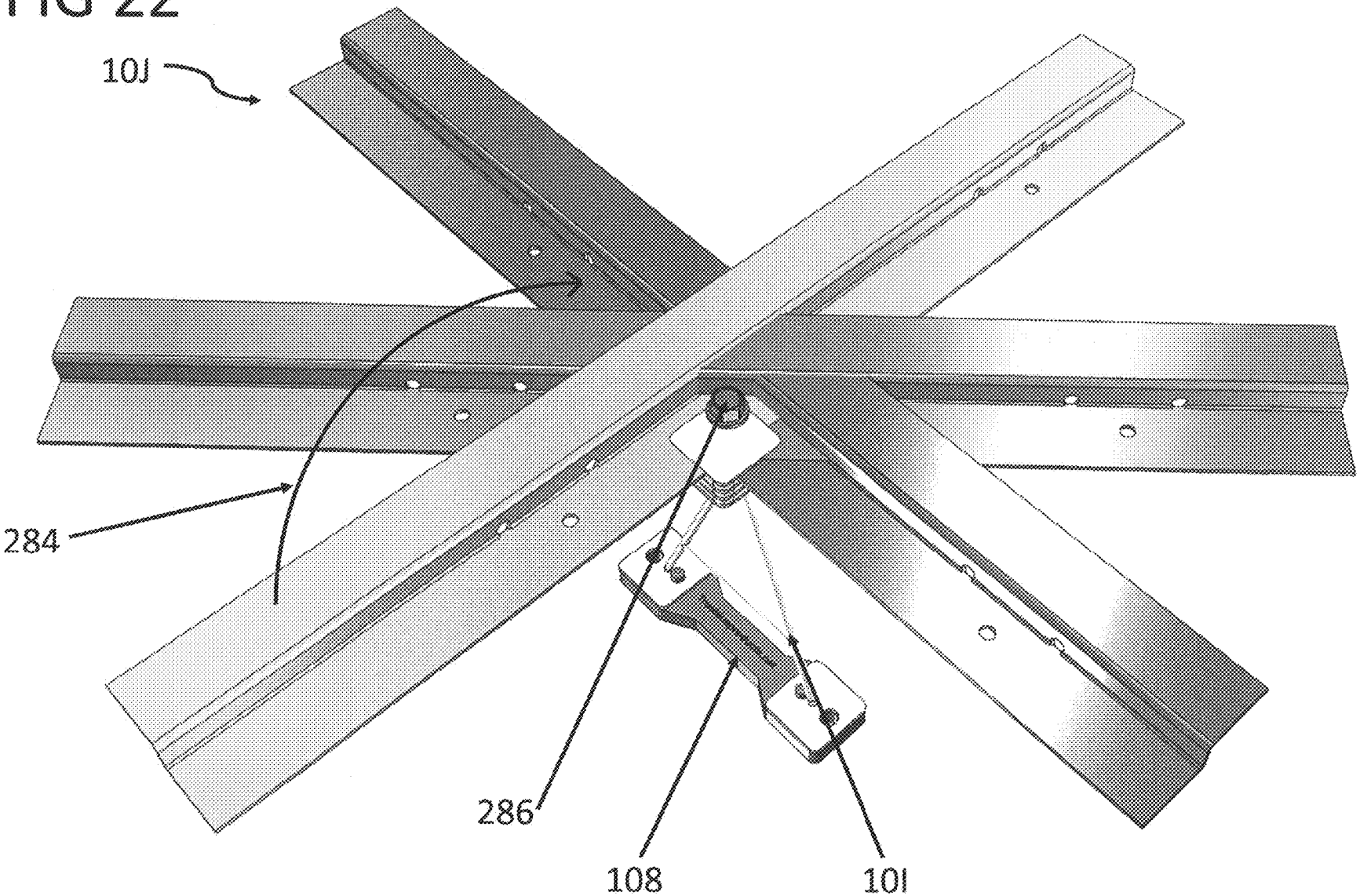
FIG. 22 is a 3D isometric plan view of the girt being rotated on the wire clip girt holder to show a portion of the rotatable movement it may have without rotating the wire clip 180 degrees.

FIG. 22 shows Girt 10J being able to rotate on mounting platform 262 of clip wire 10I prior to being permanently fastened by screw 286. Rotational arrow 284 shows some of the movement possible. Isolator 108 is shown attached to clip wire 10I, which would be mounted vertically so that insulation batts (not shown here) can be also be positioned vertically between multiple attached clip wires 10.

Figure 23:
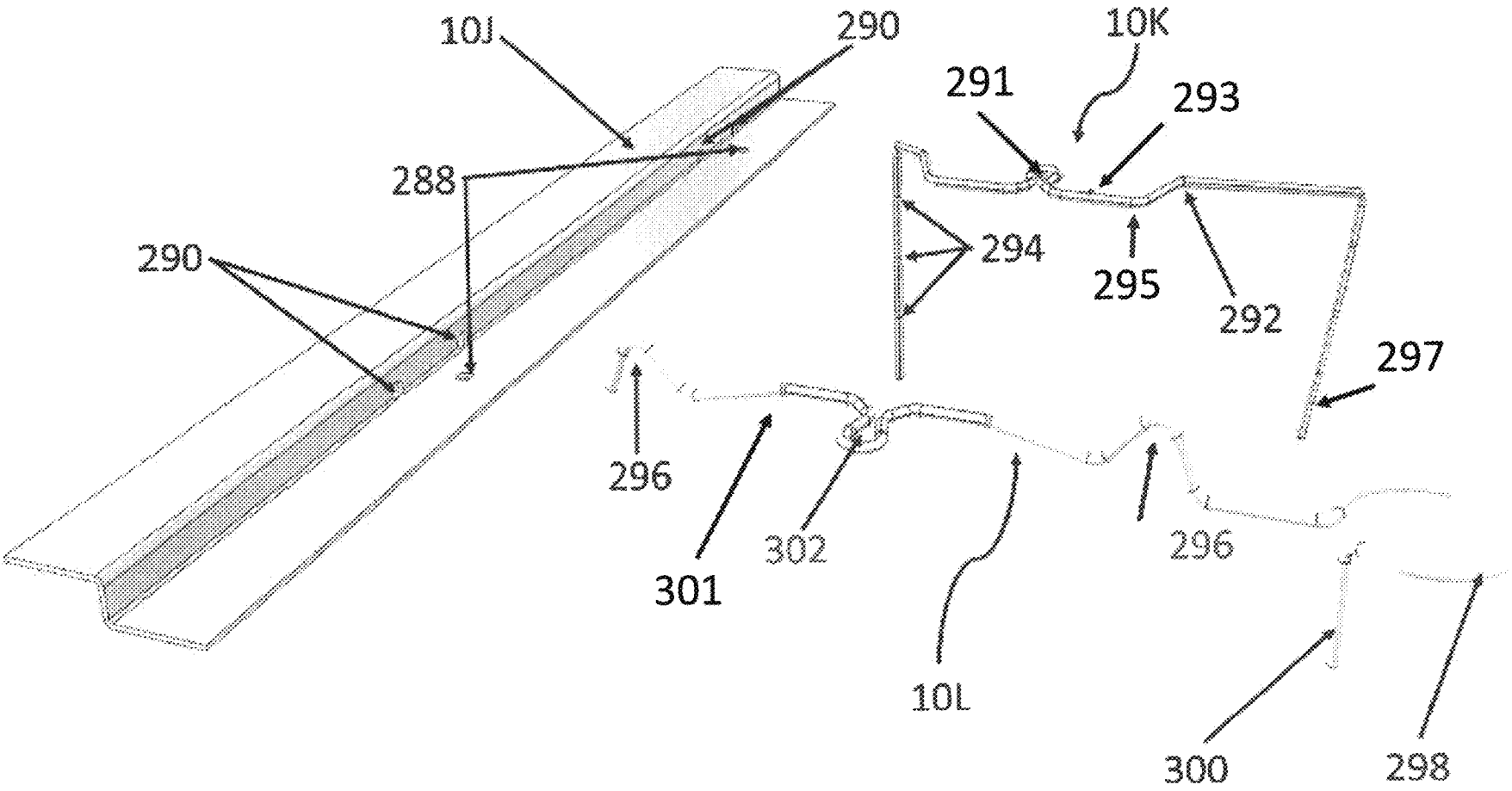
FIG. 23 is a 3D isometric elevation view of the girt and 2 girt wires of the present invention prior to installing them into and onto the girt permanently.

FIG. 23 shows girt 10J as a "Z" shape with wire insertion holes 290 for girt wires 10K and 10L to have one side guided into. Once girt wires 10K and 10L are inserted properly they are permanently fastened to girt 10J by a fastener (not shown) into hole 288. Girt wire 10K is shown having mounting hole 291, arms 293 moving away from hole 291 in opposite directions, elbows 295 turning the wire material perpendicular to arms 293, then making bends 292 which cause the wire material to go in a downward direction so as to create spring tension (not shown) when placed onto/into and against a surface such as insulation (not shown) to hold the insulation (not shown) in place. Bends 294 are bump forming to create a pseudo radius in penetrating arms 297. Girt wire 10L has humps 296 which allow for another foreign material such as conduit or conductors (not shown here) to be held between them and a substrate material such as insulation. Mounting hole 302 is used to permanently fix girt wire 10L to girt 10J with a mechanical fastener (not shown here). Ring 298 is used for holding other foreign materials (not shown) such as electrical Inverters against or apart from the insulation (not shown) securely to keep in in a fixed location. Penetrating arm 300 may enter the insulation (shown in FIG. 24) to prevent the insulation (shown in FIG. 24) from moving due to static and dynamic loads. Penetrating arm 300 may further support, align or attach to an electrical inverter (not shown) or other item (not shown) held in ring 298. Bends 301 help create spring tension when (not shown) when placed onto/into and against a surface such as insulation (not shown).

Figure 24:
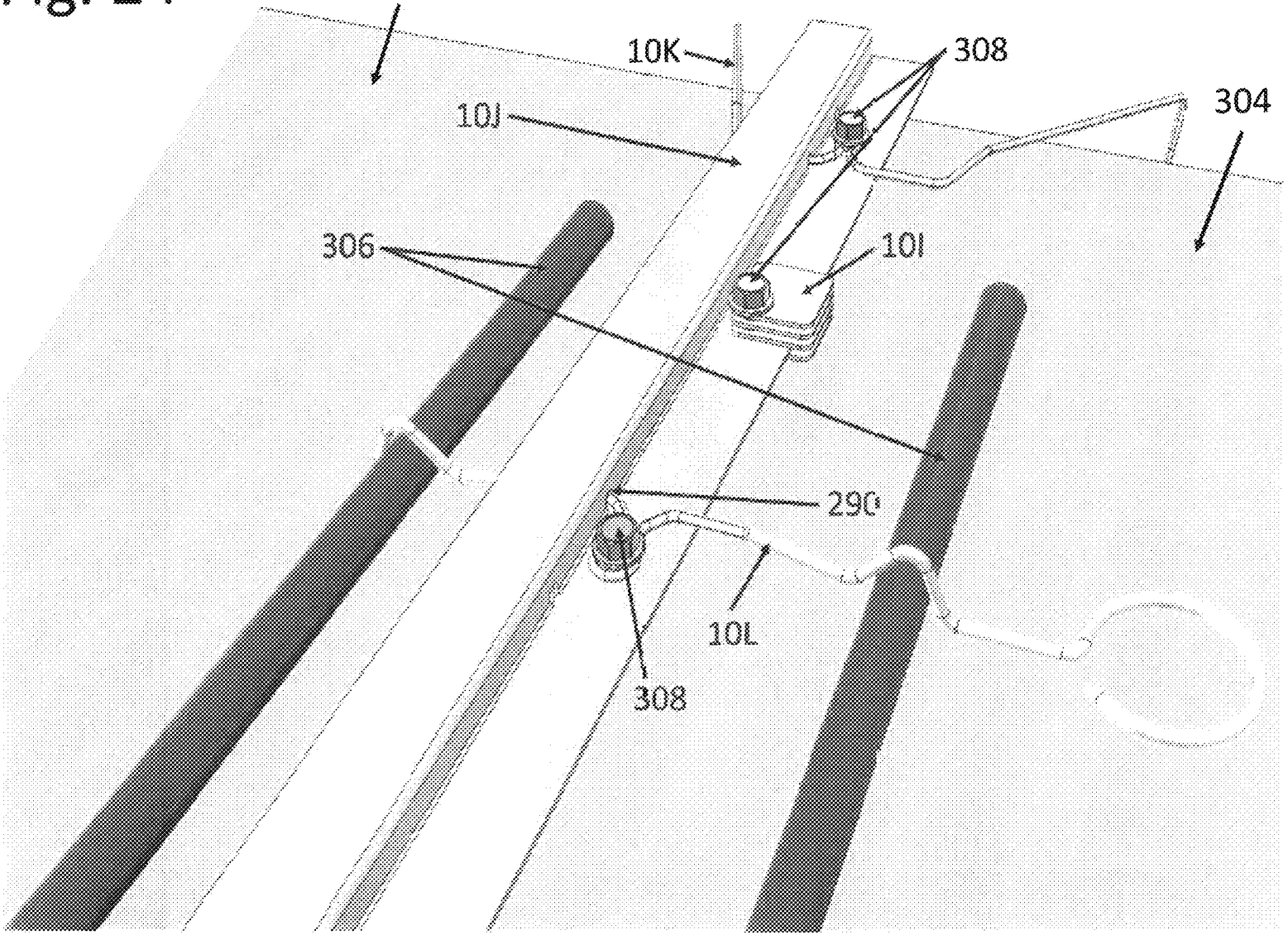
FIG. 24 is a 3D isometric plan view of the components of FIGS. 21 through 23 fully assembled and including insulation, conduits and pipes.

FIG. 24 shows all components of FIGS. 21 through 23 assembled with insulation 304 being installed below girt 10J, girt wires 10 K and 10L inserted into holes 290 in opposite directions, one facing forward and the other back. Screws 308 are shown to permanently affix girt 10J to clip wire 10I as well as girt wires 10K and 10L to girt 10J. Conduits 306 are shown held beneath humps 296 of girt wire 10L and held against and into insulation 304 so that they can't move in any direction due to friction.

While the foregoing embodiments of the application have been set forth in considerable particularity for the purposes of making a complete disclosure of the invention, it may be apparent to those of skill in the art that numerous changes may be made in detail without departing from the spirit and principles of the application. Additionally, combinations and interchangeability or inter-use of components and embodiments should be considered apparent to the spirit and principles of the application, and in which all terms are meant in their broadest, reasonable sense unless otherwise indicated. Any headings utilized within the description are for convenience only and have no legal or limiting effect.

What is claimed is:

1. A device for attaching insulation and façade systems to a building, comprising a formed wire having: a first support leg; said first support leg terminating into a second support leg which is substantially perpendicular to said first support leg; second support leg terminates into a first formed substrate attachment hole which is in plane with said first and second support legs; said first formed substrate attachment hole terminates into a substantially vertical arm which extends at an angle from said first formed substrate attachment hole; said substantially vertical arm terminates into a first formed sub-girt attachment hole; said first formed sub-girt attachment hole terminates into a substantially parallel arm said parallel arm terminates into a second formed sub-girt attachment hole which is at a specified distance from said first formed sub-girt attachment hole; said second formed sub-girt attachment hole then terminates into a substantially perpendicular leg; said substantially perpendicular leg terminates into a second formed substrate attachment hole which is substantially perpendicular to said substantially perpendicular leg and on the same plane as said first formed substrate attachment hole; said second formed substrate attachment hole terminates into a third support leg which then terminates into a substantially perpendicular fourth support leg; said third and fourth support legs are substantially a mirror image of said first and second support legs.

2. The device of claim 1 in which said first, second, third and fourth support legs as well as first and second formed substrate attachment holes act to prevent movement of said device in relationship to any substrate including thermal isolators.

3. The device of claim 1 in which said surfaces of first, second, third and fourth support legs as well as first and second formed substrate attachment holes act to increase square inches of contact to adjacent materials to spread loads out over a larger area.

4. The device of claim 1 in which first and second formed sub-girt attachment holes, when connected to sub-girts with fasteners, prevents rotation of said device of claim 1 when more than one said device is mounted to said sub-girt using said fasteners in all said first and second formed sub-girt attachment holes.

5. The device of claim 1 in which said substantially vertical arm utilizes the tensile strength of its material to support dead loads imposed onto said device of claim 1.

6. The device of claim 1 in which said substantially perpendicular leg utilizes the tensile and compressive strengths of its material to counteract imposed dynamic loads towards and away from said vertical wall.

7. The device of claim 1 in which said device and all of its said aspects are utilized to reduce thermal and vibration (noise) transfer to and from a building.

8. The device of claim 1 wherein said first and second formed sub-girt mounting holes allow for said sub-girts to be independently positioned to easily plane and level a wall prior to façade mounting system attachment.

9. A device for supporting substantially greater loads in combination with the device of claim 1, comprising a formed wire having: an obround end; said obround end terminating to a substantially straight section; said straight section terminating in a circular end.

10. The device of claim 9 in which said obround end fits over or adjacent to said first formed sub-girt attachment hole of the device of claim 1.

11. The device of claim 9 in which said circular end is mounted in alignment with said second formed substrate attachment hole of said device of claim 1, and which are together mechanically attached to said wall with a substrate fastener.

12. A device for preventing perpendicular panel returns from coming apart, in conjunction with the devices of claim 1, comprising a formed wire having: a first end which is in communication with the inside of a first parallel panel return (parallel to the face of the panel); said first end terminating in a first sharp bend; said first sharp bend being in plane with said first end and terminating in a first opposing bend; said first opposing bend being in plane with said first sharp bend and terminating in a straight section; said straight section being in plane with said first opposing bend and terminating in a second opposing bend; said second bend being in plane with said straight section and terminating in a third opposing bend; said third opposing bend being in plane with said straight section and terminating in a second end; said second end being substantially in plane with said straight section and terminating against and in communication with a second parallel panel return.

13. A device for isolating thermal and acoustic transfer from between the device of claim 1 and said wall of claim 1, consisting of a plastic injection molded part comprising: a body; said body terminating in a left and right end; said left and right ends and body having deeply curved edges on all sides; said left and right ends having indentations on the back-side; said indentations having deeply curved edges; said left and right ends having formed channels below their outer surface for embedment of said first and second support legs and said first and second formed substrate attachment holes of said device of claim 1; said left and right ends having holes; said holes terminating into a smaller holes; said smaller holes terminating into said indentations on the back-side; said holes terminating on the front-side in circular angled risen sections surrounding the perimeter of said holes; said circular angled risen sections seat tightly and conform to said first and second formed substrate attachment holes of said device of claim 1.

14. The device of claim 13 in which said formed channels include an incline angle on at least one side; said formed channels allowing portions of said device of claim 1 to enter when expanded, but when contracting said portions of the device of claim 1 said incline angles prevent said portions of the device of claim 1 from exiting said formed channels, particularly when said incline angles oppose each other and said device of claim 1 is under spring tension.

15. The device of claim 13 wherein the outer circumference of said indentations seats against a weather barrier, and said deeply curved edges not damaging said weather barrier to provide a seal of the device of claim 13 against said weather barrier.

16. The device of claim 13 wherein said circular angled risen sections and said holes are penetrated by the threads of substrate fasteners, and wherein said penetrations help prevent water intrusion between said threads of said substrate fasteners and said holes and circular angled risen sections.

17. The device of claim 13 wherein said smaller holes allow for said fasteners to locate and penetrate through, yet fit the shaft of said fasteners tight as to prevent counter-rotation of said fasteners while further preventing water to enter or exit said small holes when said fasteners are inserted.

18. A device for structurally mounting insulation and hardware from sub-girts mounted externally of insulation, in conjunction with the devices of claim 1, comprising a formed wire having: a mounting hole; said mounting hole terminating to first and second straight sections to the side and in opposing directions to each other and in plane with said mounting hole; said first and second straight sections terminating in first and second angled sections positioned somewhat perpendicular to said first and second straight sections at an angle directed towards a wall; said first and second angled sections terminating in a direction opposite said wall into first and second humps; said first and second humps providing a space for conductors, conduits, pipes and other hardware to pass under; said first hump terminating in a first end directed towards said wall; said first end partially penetrating and supporting insulation materials; said second hump terminating to a parallel section (in relationship with said first and second straight sections); said parallel section terminating in a formed shape matching any component such as an electrical inverter for solar panel systems; said formed shape being substantially parallel with said first and second straight sections and terminating into a perpendicular arm; said perpendicular arm directed towards said wall; said perpendicular arm terminating in a second end.

19. The device of claim 18 wherein said first and second humps trap said conduits, said conductors, said pipes and other hardware between them and insulation materials to prevent their movement, including said insulation which are penetrated by said second end and said perpendicular arm.

20. The device of claim 18 wherein said formed shape and said perpendicular arm may be formed to support said hardware either within said insulation, outside of said insulation, or partially within and outside of said insulation.

21. The device of claim 18 wherein said first and second ends may have locking washers inserted over them to prevent over penetration or damage to said insulation due to spring pressure of the device of claim 18 onto said insulation to force said insulation against said wall.

22. A device for attaching façade systems to a building or sub-girt, comprising a formed wire having: a substrate mounting hole formed in a clockwise manner and parallel to an adjacent wall; said substrate mounting hole having an end which extends upwards and away from said wall, and which is compressed by a first fastener during installation, to which said end frictionally prevents said fastener from rotating backwards once installed (similar to a lock washer); said substrate mounting hole extends the opposite direction to terminate into a first perpendicular leg; said first perpendicular leg terminates into a first parallel leg (to said substrate mounting hole orientation); said first parallel leg terminates into first coil which extends away from said wall; said first coil terminating into a second parallel leg which extends for a distance away from said substrate mounting hole and parallel to said first parallel leg; said second parallel leg terminates to a perpendicular half-circle extending away from said wall; said perpendicular half-circle terminates to a third parallel leg which is in plane with said second parallel leg and in the direction of said substrate mounting hole; said third parallel leg terminates into a second coil which extends further away from said wall; said second coil is parallel to said first coil and who's hole is positionally aligned with hole of said first coil for installation of a second fastener through them; said second coil terminating into a fourth parallel leg which extends directionally the same as said third parallel leg; said fourth parallel leg terminates in a perpendicular support arm; said perpendicular support arm is parallel to said wall; said perpendicular support arm terminates to a perpendicular support finger; said perpendicular support finger extends away from said wall and terminates into a parallel half-circle; said parallel half circle terminating in a second end.

23. The device of claim 22 in which said first parallel leg supports an inserted reveal between said first parallel leg and the back of a façade panel.

24. The device of claim 22 in which said first and second coils act as a means to allow said second fastener to enter but not easily be removed; said first and/or second coils tightening around said second fastener during counter-rotation to prevent said second fastener from backing out.

25. The device of claim 22 in which said perpendicular half-circle and said second and third parallel legs allow for a third fastener to be inserted between them and into a panel stiffener, effectively connecting said panel stiffener to one or more of said device of claim 22.

26. The device of claim 22 in which a second panel return is positionally fixed between said first coil and said second coil, with said second fastener passing through said hole of said first coil, through said panel return, and through said second coil to structurally support said panel.

27. The device of claim 22 wherein said fourth parallel leg, said perpendicular support arm, said perpendicular support finger, said parallel half-circle and said end are used to support a first panel return and said second panel return, and the back of the face of said panel.

28. The device of claim 22 wherein said second end may enter a mounting hole in said panel.

* * * * *